United States Patent [19]

Nakano et al.

[11] 4,107,568

[45] Aug. 15, 1978

[54] FACE PLATE FOR COLOR PICK-UP TUBE

[75] Inventors: Toshio Nakano, Hachioji; Akira Sasano, Kodaira; Ken Tsutsui, Tachikawa; Haruo Matumaru, Tokyo, all of Japan

[73] Assignees: Hitachi, Ltd.; Hitachi Electronics Ltd., both of Japan

[21] Appl. No.: 524,274

[22] Filed: Nov. 15, 1974

[30] Foreign Application Priority Data

Dec. 3, 1973 [JP] Japan ..... 48-134306
Aug. 2, 1974 [JP] Japan ..... 49-88049

[51] Int. Cl.[2] ..... H01J 31/46
[52] U.S. Cl. ..... 313/371; 358/46
[58] Field of Search ..... 313/371, 480; 106/54 (U.S. only); 358/46

[56] References Cited

U.S. PATENT DOCUMENTS

| | | | |
|---|---|---|---|
| 2,813,989 | 11/1957 | Weimer | 313/371 |
| 2,937,100 | 5/1960 | Oldfield et al. | 106/54 X |
| 3,085,887 | 4/1963 | Labino et al. | 106/54 X |
| 3,772,552 | 11/1973 | Kubota | 313/371 |
| 3,795,523 | 3/1974 | Moriya et al. | 106/54 |
| 3,912,962 | 10/1975 | Nobutoki | 313/388 X |
| 3,927,340 | 12/1975 | Suzuki | 313/371 |
| 3,928,160 | 12/1975 | Nobutoki | 313/386 X |

*Primary Examiner*—Robert Segal
*Attorney, Agent, or Firm*—Craig & Antonelli

[57] ABSTRACT

A face plate for a color pick-up tube which comprises a transparent substrate, stripe-like color filters formed on the transparent substrate, a protection layer deposited so as to cover the stripe color filters and the exposed portions of the transparent substrate, stripe-like transparent electrodes formed on predetermined portions of the protection layer, a photoconductive layer, bus bar electrodes and an insulation layer.

The insulation layer and the protection layer are, respectively, formed of different materials which have different resistances to an etching solution, whereby the stripe-like filters are protected from the adverse influence of the etching solution used to form the insulation layer by a photoetching treatment.

10 Claims, 5 Drawing Figures

FACE PLATE FOR COLOR PICK-UP TUBE

The present invention relates to a face plate of a pick-up tube for use in a color television camera which is composed of one or two pick-up tubes. Usually, the television cameras of this type are referred to as single-tube color cameras and two-tube color cameras, respectively. The pick-up tube used in these cameras is referred to as the pick-up tube for a color television and hereinafter simply called the color pick-up tube.

There are known various types of color pick-up tubes, typical examples of which are the color pick-up tubes of a frequency division multiplexing type, a phase division type and of a multi-electrode type. The present invention concerns among others the color-pick tube of the multi-electrode type.

FIG. 1 is a sectional view to illustrate a structure of a tricolor vidicon which is one of the most familiar color pick-up tubes of the multi-electrode type. Referring to FIG. 1, light incident upon a face plate glass 7 is transmitted through a transparent, thin insulator plate 1, stripe filters 2 and stripe electrodes 3 to a photoconductive layer or film 4. The photoconductive layer 4 is scanned from the rear side by an electron gun 5, whereby the falling optical or light image is divided into three primary colors of red (R), green (G) and blue (B) and taken out of the vidicon as the corresponding color signals through output terminals 8. Numeral 6 designates an envelope of glass.

FIG. 2 is a partial plan view showing a construction of the face plate for the tricolor vidicon shown in FIG. 1. The stripe filters 2 are disposed in an alternate array for the colors R, G, B, R and so forth. Each of the stripe filters 2 has the respective stripe-like transparent electrode 3 formed thereon. The signals corresponding to the color information obtained from incoming light are led outwardly independently from the transparent electrodes 3 by way of bus bars 9 and the output terminals 8 connected thereto.

Although the color pick-up tube of the multi-electrode type is historically the oldest among the pick-up tubes, it does not even now enjoy practical use because of its complicated construction; nevertheless it is simple in principle in contrast to other types of color pick-up tubes used for actual applications. In other words, due to the fact that the face plates of the hitherto known multi-electrode type color pick-up tubes inclusive of the most typical tricolor tube or vidicon have been formed by a mask evaporation method throughout all the manufacturing steps, the desired adequate precision can not be accomplished, which in turn results in a lowering of the quantity yield.

The face plates for the color pick-up tubes of complicated structure thus have encountered extreme difficulties in the manufacture thereof.

Accordingly, an object of the present invention is to provide a face plate of a novel structure for the color pick-up tube which can be easily manufactured and perform similar functions as those of the heretofore known multi-electrode type of color pick-up tubes such as the tricolor tube or vidicon.

Another object of the invention is to provide a face plate for the color pick-up tubes which can be formed by a photo-etching method throughout all the manufacturing steps without resorting to the masking vacuum evaporation method.

To accomplish the above and other objects which will become apparent from the description made hereinafter, the invention proposes to interpose a protection film or layer between the stripe filters and the insulator layer and the transparent electrodes in order to protect the stripe filters from any influence of an etching solution upon forming the insulation alyer, which thus allows the manufacture of the face plates for the pick-up tubes by a photo-etching method.

The present invention will be apparent from the following detailed description taken in conjunction with the accompanying drawings, in which.

As hereinbefore described, the face plate for the color pick-up tube of multi-electrode type comprises stripe-like color filters to decompose spatially a falling optical image into colors, stripe-like transparent electrodes disposed in correspondence and close to the stripe filters, but bars connected to the transparent stripe electrodes to serve as color signal electrodes for the colors R, G and B, multi-layer wirings provided exteriorly of an effective image plane area, and a photoconductive layer or film deposited on the stripe filters and the transparent electrodes in the area corresponding to the effective image plane.

Figure 1:
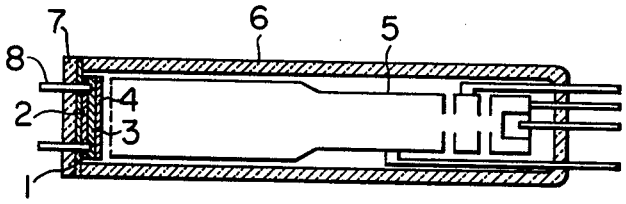
FIG. 1 PRIOR ART
FIG. 1 is a sectional view to show a main portion of a hitherto known color pick-up tube.
Figure 2:
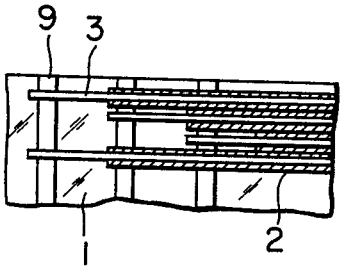
FIG. 2 PRIOR ART
FIG. 2 is a plan view illustrating arrangement of bus bar electrodes, stripe-like transparent electrodes and stripe color filters of a conventional multi-electrode type color pick-up tube of a construction such as shown in FIG. 1.
Figure 3:
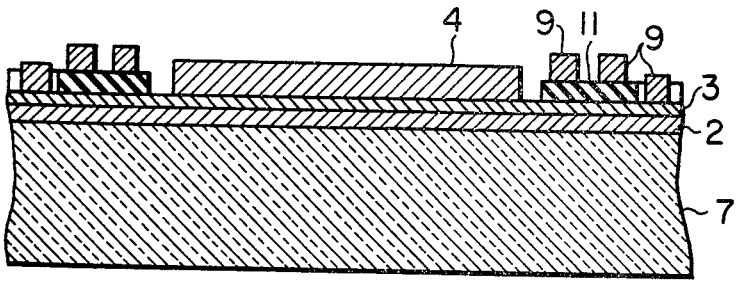
FIG. 3 PRIOR ART
FIG. 3 is a sectional view to show a structure of a hitherto known face plate for the color pick-up tube, and, FIGS. 4 and 5 show face plates for the color pick-up tube according to the invention in sectional views.

FIG. 3 shows a structure of a conventional face plate for a hitherto known color pick-up tube of a multi-electrode type in a section taken along the direction parallel to the stripe filters and the transparent electrode stripes. The aforementioned thin plate 1 is omitted because a sufficient insulation can be assured by the face glass 7. Employed as the stripe filters are usually interference filters having respective thin films such as of $TiO_2$ deposited thereon. The stripe filters for colors R, G and B absorb or transmit the allotted one of the three primary colors and are arrayed cyclically in parallel with one another.

The face plate shown in FIG. 3 is commonly manufactured in the following manner. At first, the transparent glass substrate 7 is deposited with the stripe color filters 2 thereon and additionally formed with the stripe-like transparent electrodes 3. Next, the insulation layer 11 is deposited on the multilayer interconnected circuit or wiring portion and the bus bar electrodes 9 corresponding to the colors R, G and B are formed. Finally, the photoconductive layer 4 is deposited to complete the face plate which is then assembled into the envelope of the color pick-up tube.

From the standpoint of mass production, it is desirable that all the steps of forming the various components or portions of the face plate mentioned above are to be carried out by a photoetching method, for the reason as hereinbefore described. For example, the array of the stripe-like transparent electrodes should preferably be formed of a transparent composition containing therein tin oxide ($SnO_2$) as the main component by a pattern etching method using a chemical etching solution.

However, the manufacturing of the face plate having the structure shown in FIG. 3 by the photoetching is accompanied by a serious difficulty. That is, the stripe-like filters 2 are corroded by the etching solution containing hydrofluoric acid or HF as the main component which is usually used to form the insulation layer 11, as the result of which the above structure of the face plate can not be realized actually.

An object of the invention is therefore to overcome the difficulty mentioned above and provide a novel target face plate for the mutli-electrode type color pick-up tube having a structure suitable for the manufacturing on a mass production scale using photo-etching technics.

Figure 4:
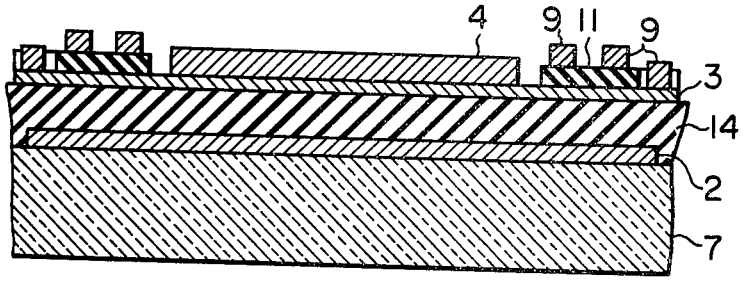

FIG. 4 shows an exemplary embodiment of a target face plate according to the invention in sectional view. The structure shown in FIG. 4 differs from the one shown in FIG. 3 in that a protecting layer or film 14 of an insulator material is interposed between the stripe filters 2 and the stripe-like transparent electrodes 3 so as to cover the stripe filters 2.

Materials for the glass substrate 7, the protection layer 14, the stripe-like transparent electrodes and the insulation layer 11 have to be selected in consideration of possible deformations of distortion to be avoided, mechanical strength to be attained or the like factors. More specifically, the protection layer 14 and the insulation layer 11 are both to be made of materials having the same thermal expansion coefficient, which should moreover be equal to that of the flass substrate 7 in order to attain desirable results. When the structure of the target face plate according to the invention was manufactured by using a composition comprising for the most part thereof $SiO_2$, $B_2O_3$, $Al_2O_3$ and BaO as the material for the insulation layer 11 and the protection layer 14 which is likely to be easily thin-filmed, it has been found that the protection layer 14 was subjected to corrosion upon photo-etching the insulation layer 11, whereby the transparent stripe electrodes formed on the protection layer 14 became deteriorated.

In view of the above fact, it is necessary to use for the layers in question such materials which have not only the same physical properties such as mechanical strength, thermal expansion coefficient or the like, but also exhibit remarkably varied resistances to the etching solution employed in the photoetching process.

After repeated experiments using a materials of the glass series containing for most parts thereof $SiO_2$, $B_2O_3$ and $Na_2O$ and materials of the glass series containing $SiO_2$, $B_2O_3$, $Al_2O_3$ and BaO as main components, which materials have chemical properties remarkably different from each other, it has been found that several kinds of glass having the same physical properties such as linear expansion coefficients in particular and providing utterly different resistances to the etching solution employed in the photo-etching treatment can be obtained by selecting appropriately the ratios of compositions for the above glass materials.

Among the available glass materials, the materials having the greatest resistance to the etching solution may be used for the protection layer. In this connection, the glass composition composed mainly of $SiO_2$, $B_2O_3$ and $Na_2O$ is far better than the glass composition of $SiO_2$, $B_2O_3$, $Al_2O_3$ and BaO in respect of the resistance to the etching solution and therefore well suited to the use for the protection layer.

Further, because these glass materials may have a thermal expansion coefficient equal to that of a thin film of $SnO_2$, delamination of films is unlikely to occur upon the deposition of $SnO_2$ at a high treatment temperature.

As will be appreciated from the foregoing description, the protection layer used according to the teaching of the invention has to exhibit an adequate resistance to the etching solution employed when the insulation layer and the bus bar electrodes are formed in desired configurations or patterns.

Turning the discussion to the filters, a multi-layer interference filter is used as the stripe filters in most color pick-up tubes. As is well known, the interference filters for the associated colors of R, G and B are different from one another in thickness. Accordingly, when the stripe filters composed of the interference filters are covered by the protection layer, there arise considerably convexed or concaved portions in the surface of the protection layer, which renders it impossible to deposit the photo-conductive film thereon. The this reason, in the practical manufacture of the face plate for the color pick-up tube, the protection layer is previously polished by a mechanical means to thereby be made flat and thereafter the photoconductive film and the insulation layer are deposited. However, a protection layer of at least several tens of microns in thickness is apparently required for the mechanical polishing and thus it becomes important to pay the consideration not only to the chemical properties of the protection layer, but also to the optical property or the light transmission factor thereof.

Figure 5:
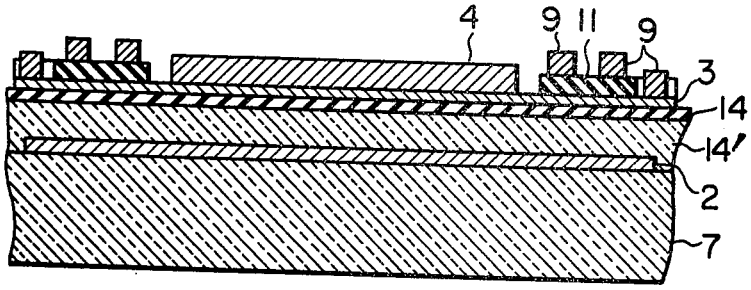

Referring to FIG. 5 which shows an exemplary embodiment of the invention wherein a material having a rather small light transmission factor is used for the protection layer, it can be seen that the stripe filter 2 deposited on the face glass 7 is covered by a flattening layer 14', and the protection layer 14 is deposited thereon. Since the flattening layer 14' is made relatively thick, as mentioned above, the light transmission factor of this layer is required to be of a relatively large value. For convenience' sake, the layer 14' may be made of the same material as that of the glass plate 7. Since the surface of the flattening layer has been made flat, it is unnecessary to form the protection layer 14 thick. In practice, the protection layer 14 can be made very thin since it is only required that the stripe filters 2 and the flattening layer 14' are protected when the insulation layer 11 or the like are subjected to etching treatment. In this manner, a decrease in the intensity of incident light passing through the protection layer 14 can be suppressed to a minimum, even if the material for the layer 14 is of a relatively low light transmission factor.

As hereinbefore described, the thermal expansion coefficients of glass materials used for the face plate structure play a very important role for attaining the desired results. In this connection, it is to be noted that all of the components of the glass material do not necessarily exert an influence on the thermal expansion coefficient, but the amounts of certain components will influence the thermal expansion coefficient.

For example, in the case of a glass material of $SiO_2$ - $B_2O_3$ - $Na_2O$ series, a variation in the ratio of $B_2O_3$ to $SiO_2$ will bring about little variation in the thermal expansion coefficient. However, when the amount of $Na_2O$ is varied considerably, the thermal expansion coefficient is varied substantially in proportion thereto.

In the case of a glass material of $SiO_2$ - $Al_2O_3$ - $B_2O_3$ - BaO series, the thermal expansion coefficient is substantially resistant to variations in the ratio of ($Al_2O_3$ + $B_2O$) to $SiO_2$, while it is varied in proportion to variation in the amount of BaO.

It is thus possible to approach the thermal expansion coefficients of both glass materials very close to each other by appropriately selecting the contents of $Na_2O$ and BaO in the respective glass materials.

EXAMPLE 1

In the structure shown in FIG. 4, the glass substrate 7 and the protection layer 14 were formed of the same glass composition containing 70% (by weight) of $SiO_2$, 18% of $B_2O_3$ and 12% of $Na_2O$. The linear expansion coefficient of this glass composition was $4.7 \times 10^{-6}$/deg. which approximately coincides with the linear expansion coefficient, i.e. $4.0 \times 10^{-6}$/deg. of the $SnO_2$-thin film destined to form the transparent electrodes.

For the insulation layer 11, a glass composition was used which is chemically utterly different from the above mentioned glass composition and contains 50% (by weight) of $SiO_2$, 13% of $Al_2O_3$, 17% of $B_2O_3$ and 20% of BaO. The linear expansion coefficient of this glass composition was $4.5 \times 10^{-6}$/deg. and approximately equal to those of the above mentioned protection layer and the $SnO_2$ layer.

The glass material for use as the insulation layer of film is required to be easily photo-etched. The above glass composition will meet this requirement and can be easily photo-etched to the desired configuration with a high accuracy by using an etching solution containing hydrofluoric acid and nitric acid as its main components, for example.

On the other hand, the glass composition for the glass substrate 7 and the protection layer 14 is stable in the presence of the etching solution contaning hydrofluoric acid and nitric acid and is etched very little. By selecting appropriately the composition of the etching solution, one can easily prepare a variety of solutions having etching rates variable in the range of factors 10 to 100. Accordingly, the insulation layer of the aforementioned composition can be formed in a desired configuration by the photo-etching method without damaging the protection layer 14 and hence the transparent stripe electrodes 3, whereby the structure of the target face plate shown in FIG. 4 can be realized without difficulties.

Next, a process of manufacturing the face plate according to the invention will be described.

At first, the stripe color filters 2 composed of the multi-layer interference filter of $TiO_2$-$SiO_2$ were formed on the glass substrate 7 of the composition described above by a conventional method and subsequently, glass film of the same composition as the glass substrate was formed thereon in thickness of 5 to 10 $\mu$ by a sputtering or the like method to obtain the protection layer 14. After having flattened the exposed surface of the protection layer 14 by optical polish, the transparent electrode material including SnO as the main component was deposited on the protection layer 14 through a conventional high temperature process and then subjected to the photo-etching treatment to form a desired array of the stripe-like transparent electrodes 3. Next, the first mentioned glass composition including BaO differing from the composition of the protection layer 14 was deposited by a high frequency sputtering method and formed into the desired insulation layer 11 through the photo-etching process using an etching solution containing 1 part of hydrofluoric acid, 4 parts of nitric acid and 30 parts of water. Finally, the bus bar electrodes 9 were provided in a well multi-layer wiring arrangement and the photoconductive layer 4 was deposited to complete the structure of the target face plate shown in FIG. 4.

As will be understood from the foregoing description, an improved target face plate having an image area very little deteriorated can be manufactured through a well stabilized process with a high yield. Although the glass composition of $SiO_2$, $B_2O_3$ and $Na_2O$ was used for the protection layer in this example, $Al_2O_3$ may be added thereto.

EXAMPLE 2

The structure of the face plate shown in FIG. 5 was manufactured in this example.

In the first place, the multi-layer interference filter was deposited by a conventional method on the face glass 7 to form the stripe filters 2. Subsequently, a glass composition containing 50% by weight of $SiO_2$, 13% by weight of $Al_2O_3$, 17% by weight of $B_2O_3$ and 20% by weight of BaO was deposited about 7 to 9 $\mu$ in thickness by a high frequency sputtering method to thereby form the flattening layer 14' to flatten the concaved or convexed uneven surface of the filters. After having flattened the exposed surface of the layer 14', a glass composition containing 70% of $SiO_2$, 18% of $B_2O_3$ and 12% of $Na_2O$ (by weight) was deposited on the layer 14' by a sputtering method to form the protection layer 14. The transparent electrodes 3, insulation layer 11, but bar electrodes 9 and the photoconductive layer 4 were formed in a similar manner as in the preceeding Example 1.

Although the insulation layer 11 was made of the same glass material as the flattening layer 14', the protection layer 14 provided on the flattening layer 14' and exhibiting quite different resistance to chemicals was excluded from any influence caused by the photo-etching treatment of the insulation layer.

The thermal expansion coefficient of the glass material used for the flattening layer 14' and the insulation layer 11 was $4.7 \times 10^{-6}$/deg.; which was approximately equal to the thermal expansion coefficient of the glass material for the protection layer 14, the latter being in reality $4.5 \times 10^{-6}$/deg.. By virtue of this fact, neither delamination nor cracks occurred even when the flattening layer was deposited in a relatively greater thickness (for example, about 10 $\mu$ thick). It is known that a glass film formed by the sputtering method is colored dependenting on types of the glass material and the conditions of the sputtering as actually employed. For example, the light transmission factor of the protection layer 14 was decreased, as the thickness thereof was increased in the present Example. Particularly, a remarkable decrease in the light transmission factor was observed in the range of short wave lengths in the vicinity of 400 nm. Accordingly, it will be desirable to form the protection layer 14 as thin as possible. In this connection, no appreciable difference could be recognized in the light transmission factor of the glass material used for the flattening layer 14' formed in different thicknesses such as 1.4 $\mu$ and 7.4 $\mu$ thick. This means that the flattening layer 14' may be formed in an adequate thickness.

EXAMPLE 3

In the structure of the face plate shown in FIG. 5, the flattening layer 14' was made of $SiO_2$, and the protection layer 14 was formed of a glass composition containing 70% (by weight) of $SiO_2$, 18% of $B_2O_3$ and 12% of $Na_2O$, while the insulation layer 11 was made of $SiO_2$.

Since the glass materials of the above compositions as well as the stripe-like color filters have high dielectric constants, capacitances will exist among the electrodes, which may possibly produce mixed color to deteriorate color purity.

However, by using $SiO_2$ having an extremely low dielectric constant for the flattening layer 14' and making the glass layer 14 of $SiO_2$-$B_2O$-$Na_2O$ series thin, possible capacitances between the electrodes can be lowered, and thus an excellent face plate for a color pick-up tube not susceptible to color mixture can be obtained.

What we claim is:

1. A face plate for a color pick-up tube, comprising, (a) a transparent substrate, (b) stripe-like color filters formed on said transparent substrate, said filters being disposed cyclically and in parallel to one another, (c) a transparent protection layer formed so as to cover said stripe-like color filters and exposed portions of said transparent substrate, (d) stripe-like transparent electrodes deposited over said stripe-like color filter through said protection layer interposed therebetween, and (e) bus bar electrodes electrically connected to said transparent electrodes in such a manner that each bus bar electrode is connected with corresponding transparent electrodes but insulated from the remaining transparent electrodes by an interposed insulation layer, further comprising a flattening layer for correcting unevenness of surface, which layer is disposed between said protection layer and said stripe-like color filters and said transparent substrate.

2. A face plate as set forth in claim 1, wherein said flattening layer is formed of a composition containing $SiO_2$, $Al_2O_3$, $B_2O_3$ and BaO as main components.

3. A face plate as set forth in claim 1, wherein said flattening layer is made of $SiO_2$.

4. A face plate for a color pick-tube comprising:

a transparent substrate;

a plurality of stripe-like color filters formed on said transparent substrate, said filters being disposed cyclically and in parallel with one another;

a transparent protection layer formed so as to cover said plurality of stripe-like color filters and exposed portions of said transparent substrate;

a plurality of stripe-like transparent electrodes deposited on said transparent protection layer so as to overlie said plurality of stripe-like filters;

a plurality of bus bar electrodes, each of which is connected to a respective stripe-like transparent electrode but is insulated from the remaining transparent electrodes of said plurality of transparent electrodes; and an insulation layer disposed between the remaining transparent electrodes of said plurality of transparent electrodes and said transparent protection layer, wherein said bus bar electrodes comprises a first layer disposed on said stripe-like color filters and exposed portions of said transparent substrate; and a second layer disposed on said first layer, with said plurality of stripe-like transparent electrodes being deposited in said second layer, said second layer being made of a material the light transmission factor of which is smaller than that of said first layer.

5. A face plate for a color pick-up tube according to claim 4, wherein said first layer is made of a glass composition containing $SiO_2$, $Al_2O_3$, $B_2O_3$ and BaO.

6. A face plate for a color pick-up tube according to claim 5, wherein said second layer is made of a glass composition containing $SiO_2$, $B_2O_3$ and $Na_2O$.

7. A face plate for a color pick-up tube according to claim 4, wherein said first layer is made of $SiO_2$.

8. A face plate for a color pick-up tube according to claim 6, wherein said first layer is a glass composition comprising 50% by weight of $SiO_2$, 13% by weight of $Al_2O_3$, 17% by weight of $B_2O_3$, and 20% by weight of BaO, and said second layer is a glass composition comprising 70% by weight of $SiO_2$, 18% by weight of $B_2O_3$, and 12% by weight of $Na_2O$.

9. A face plate for a color pick-up tube according to claim 8, wherein said insulation layer is made of the same glass composition as said first layer.

10. A face plate for a color pick-up tube according to claim 7, wherein said second layer is a glass composition comprising 70% by weight of $SiO_2$, 18% by weight of $B_2O_3$and 12% by weight of $Na_2O$.

* * * * *